US010981205B2

(12) United States Patent
Faraji et al.

(10) Patent No.: US 10,981,205 B2
(45) Date of Patent: Apr. 20, 2021

(54) APPARATUS AND METHOD FOR FABRICATING HIGH STRENGTH LONG NANOSTRUCTURED TUBES

(71) Applicants: Ghader Faraji, Tehran (IR); Mohammad Motallebi Savarabadi, Tehran (IR)

(72) Inventors: Ghader Faraji, Tehran (IR); Mohammad Motallebi Savarabadi, Tehran (IR)

( * ) Notice: Subject to any disclaimer, the term of this patent is extended or adjusted under 35 U.S.C. 154(b) by 350 days.

(21) Appl. No.: 15/989,141

(22) Filed: May 24, 2018

(65) Prior Publication Data

US 2018/0272400 A1 Sep. 27, 2018

(51) Int. Cl.

*B21C 23/08* (2006.01)
*B21C 23/00* (2006.01)
*B21C 23/32* (2006.01)

(52) U.S. Cl.

CPC ..... *B21C 23/085* (2013.01); *B21C 23/001* (2013.01); *B21C 23/32* (2013.01)

(58) Field of Classification Search

CPC ..... B21C 23/085; B21C 25/02; B21C 23/001; B21C 23/002; B21C 23/007; B21C 23/01; B21C 23/02; B21C 23/04; B21C 23/08; B21C 23/12; B21C 23/18; B21C 23/183; B21C 23/21; B21C 23/217; B21C 23/32; B21C 23/211; B21C 23/212; B21C 23/214; B21C 23/215; B29C 55/22; B29C 55/30

USPC ..... 264/323, 570

See application file for complete search history.

(56) References Cited

U.S. PATENT DOCUMENTS 2,158,044 A * 5/1939 Haller ..... E04F 11/16 445/23
2,891,298 A * 6/1959 Kaul ..... B21C 23/03 86/53
3,841,128 A 10/1974 Nilsson
4,017,245 A 4/1977 Lang
4,271,240 A * 6/1981 Braun ..... B21C 23/03 428/34.1
4,449,904 A 5/1984 Austen et al.
4,462,234 A * 7/1984 Fiorentino ..... B21C 23/32 72/253.1
6,209,379 B1 * 4/2001 Nishida ..... B21C 23/001 72/253.1
7,008,577 B2 3/2006 Dehennau et al.

(Continued)

*Primary Examiner* — Shelley M Self
*Assistant Examiner* — Jared O Brown
(74) *Attorney, Agent, or Firm* — NovoTechIP International PLLC

(57) ABSTRACT

An improved apparatus and method of fabricating long nanostructured or ultrafine grained tubes includes, in one implementation, expanding and extruding a sample material through cyclic deformations. The first cycle begins with expanding the sample through a die unit by applying pressure using a punch box, then with extruding the sample by applying back pressure using a stationary mandrel, which in turn reduces the expanded sample diameter to the original diameter. The next cycle begins with inverting the die unit to further extrude the sample with no need to apply back pressure. Furthermore, resistant forces against the sample are reduced by using a lubricant material inside the die unit, thus allowing continuation of additional cycles without constraining the sample length, resulting in desired strength and elongation.

20 Claims, 9 Drawing Sheets

(56) References Cited

U.S. PATENT DOCUMENTS

| | | | | |
|---|---|---|---|---|
| 2014/0007640 | A1* | 1/2014 | Endo | B21C 23/183<br>72/352 |
| 2015/0059911 | A1 | 3/2015 | Petrov et al. | |
| 2015/0190856 | A1 | 7/2015 | Pachla et al. | |

* cited by examiner 100
140
130
150
190
120
110
180
160A
160
170
α
$R_{fillet}$
$R_d$

110

120

130

180

APPARATUS AND METHOD FOR FABRICATING HIGH STRENGTH LONG NANOSTRUCTURED TUBES

CROSS REFERENCE TO RELATED APPLICATION

This application claims the benefit of priority to Iran Application Serial Number 139650140003002419, filed on May 24, 2017, the entire content of which is incorporated herein by reference.

TECHNICAL FIELD

The present disclosure relates generally to fabricating nanostructured tubes and, more particularly, to improved apparatus for and method of fabricating high strength, long nanostructured tubes.

BACKGROUND

Over the past decade, severe plastic deformation (SPD) processes have revealed a significant promise in fabricating ultrafine grained (UFG) and nano-grained (NG) materials with superior and unique mechanical and physical properties. The main objective of a SPD process is to fabricate improved materials with better reliability and environmental compatibility. Such property improvements include higher strength, higher ductility, higher corrosion resistance, and/or super plasticity.

Recent development in the field of SPD processes has offered a significant promise to different industries, such as aerospace, automotive, transportation, materials handling, electronics and others, for use of materials that exhibit highly desirable mechanical and physical properties. SPD refers to a group of techniques that involve applying very large strains to various materials in order to fabricate high defect density and UFG/NG size materials. In general, in SPD processes, a significant amount of strain is applied to a piece of material, which refines microstructure of the material into an UFG/NG structure without introducing any change in the final geometrical dimension and shape of the piece of material. As such, a considerable research and development has been done to improve current SPD processes.

Some of the most commonly used SPD processes developed as a result of such research include high pressure torsion (HPT), equal channel angular pressing (ECAP), cyclic extrusion-compression (CEC), and repetitive upsetting-extrusion (RUE). Despite powerful tools for processing UFG/NG materials, these methods present some problems/limitations. For example, a restriction in size and a need for applying external back pressure usually require a complicated heavy and long machinery in SDP processes, and thus resultant deformations in the fabricated materials are not steady, which can lead to inhomogeneous deformation and even folding of the processed materials. Consequently, the entire process can lead to increase in manufacturing time and labor intensity, and thus cost inefficiency. As such, there remains a need to develop an improved SPD process to obtain UFG/NG size materials with desirable mechanical and physical properties while being timely and cost effective.

Accordingly, the present disclosure addresses providing an improved apparatus and method of severe plastic deformation for fabricating long nanostructured tubes without a need to constrain a sample length, while accommodating non-intensive labor and cost efficiency.

SUMMARY

In one general aspect, described is an improved apparatus configured for fabricating long nanostructured tubes. The apparatus for fabricating long nanostructured tubes may include a moving mandrel, an inlet channel, a punch box, a die unit, a holder unit, and a stationary mandrel. In one implementation, the moving mandrel may extend between a first end and a second end of a sample billet, and be placed inside the sample billet to simultaneously move with such sample in a cooperative manner. The inlet channel may include a first end and a second end, in which the first end can be configured to load the sample billet, and the second end can be connected to a top end of the die unit. The punch box may include a top end and a bottom end, where the bottom end can be in contact with the first end of the inlet channel, and can be configured to push the sample billet forward through the die unit, and to seal the inlet channel. The die unit may include the top end, a bottom end, and a plurality of grooves, in which the die unit can be secured to the holder unit, and can be configured to extrude the sample billet through the plurality of grooves. The stationary mandrel may include a first end and a second end, where the first end can be in contact with the sample billet, the second end can extend to the bottom end of the die unit, and can be configured to apply back pressure to such sample. A lubricant material may be poured inside the die unit to fill a space gap between the sample billet and the die unit, and to avoid a direct contact between the two.

In an aspect, the stationary mandrel may be configured to initially apply pressure to the sample billet to reduce an increased diameter of such sample through the plurality of grooves inside the die unit. In an alternative aspect, the die unit may be configured to invert after each extrusion cycle in order for the punch box to extrude the sample billet through the plurality of grooves, and to reduce the increased diameter of such sample without a need for applying back pressure via the stationary mandrel after the initial use.

In a further aspect, the simultaneous movement of the sample billet and the moving mandrel in a cooperative manner may zero out a relative velocity between the two, and may eliminate an additional amount of resistant force against such sample during extrusion. The lubricant material may prevent creation of friction forces between the sample billet and the die unit, and may eliminate an additional amount of resistant force against such sample during extrusion. The lubricant material may also apply a hydrostatic pressure to the sample billet, and may reduce an amount of required force for the punch box to push such sample through the die unit during extrusion. Reduction in the applied forces may allow continuation of an additional cycle of extrusion without a need to constrain a sample length.

In a related aspect, each extrusion cycle may apply an amount of strain on the sample billet, where each of which strain can severely deform the sample billet, and can refine a nanostructure of such sample. A total amount of strain applied on the sample billet may be equal to a summation of each of the amount of strain applied in each extrusion cycle. The refined nanostructure of the sample billet may introduce an ultrafine grained tube with high mechanical strength and long length.

In another general aspect, described is an improved method of fabricating long nanostructured tubes. In one implementation, the method of fabricating long nanostructured tubes may include the steps of placing a moving mandrel inside a sample billet, loading the sample billet into an inlet channel of an extrusion machine, where the extrusion machine can include a punch box, a die unit and a stationary mandrel, in which a top end of the die unit can be in contact with one end of the punch box and a bottom end of the die unit can extend to one end of the stationary mandrel. The method of fabricating long nanostructured tubes can also include pouring an amount of a lubricant material inside the die unit to fill a space gap between the sample billet and the die unit, and to avoid a direct contact between the two. The method of fabricating long nanostructured tubes can further include applying pressure to the punch box to push the sample billet forward through the die unit and to seal the inlet channel, and applying back pressure by the stationary mandrel to extrude such sample through a plurality of grooves inside the die unit.

In a related aspect, the method of fabricating long nanostructured tubes can also include removing the stationary mandrel, inverting the die unit, and applying pressure by the punch box to extrude the sample billet through the plurality of grooves. The method of fabricating long nanostructured tubes can further include repeating each extrusion cycle by inverting the die unit in each cycle, and by forcing the extruded sample billet to further extrude through the plurality of grooves. In an aspect, the method of fabricating long nanostructured tubes may be utilized where the sample billet can be of a tubular shape and made of solid materials.

The foregoing and other objects, features, aspects, and advantages of the present invention will become more apparent from the following detailed description of the present application when taken in conjunction with the accompanying drawings.

BRIEF DESCRIPTION OF THE DRAWINGS

Features of the subject technology are set forth in the appended claims. However, for purpose of explanation, several implementations of the subject technology are set forth in the following figures.

DETAILED DESCRIPTION

In the following detailed description, numerous specific details are set forth by way of examples in order to provide a thorough understanding of the relevant teachings. However, it should be apparent to those skilled in the art that the present teachings may be practiced without such details. In other instances, well known methods, procedures, components, and/or circuitry have been described at a relatively high-level, without detail, in order to avoid unnecessarily obscuring aspects of the present teachings. As part of the description, some of this disclosure's drawings represent structures and devices in block diagram form in order to avoid obscuring the invention. In the interest of clarity, not all features of an actual implementation are described in this specification. Moreover, the language used in this disclosure has been principally selected for readability and instructional purposes, and may not have been selected to delineate or circumscribe the inventive subject matter, resort to the claims being necessary to determine such inventive subject matter. Reference in this disclosure to "one embodiment" or to "an embodiment" means that a particular feature, structure, or characteristic described in connection with the embodiment is included in at least one embodiment of the invention, and multiple references to "one embodiment" or "an embodiment" should not be understood as necessarily all referring to the same embodiment.

A solution is proposed herein to resolve the above-motioned issues and others by providing an improved apparatus and method of fabricating long nanostructured tubes through a severe plastic deformation (SPD) technique using cyclic expansion extrusion (CEE). The initial CEE deformation may begin with expanding and extruding a sample material through a die unit by respectively applying pressure and back pressure, which in turn can reduce a diameter of the sample to the original diameter. The subsequent CEE deformation then may continue by inverting the die unit to further extrude the extruded sample, which can eliminate the need to apply back pressure to the sample as opposed to conventional CEE methods. Furthermore, by using a lubricant material inside the die unit, friction forces between the sample and the die unit can be prevented, thus reducing resistant forces against the sample while reducing required forces to push such sample through the die unit. Thereby, reduction in the applied forces may allow continuation of additional cycles of extrusion without a need to constrain a sample length, which in turn can result in a desired sample strength and elongation, as opposed to be restricted when using conventional CEE methods.

Figures 1A, 1B, 1C, 1D:
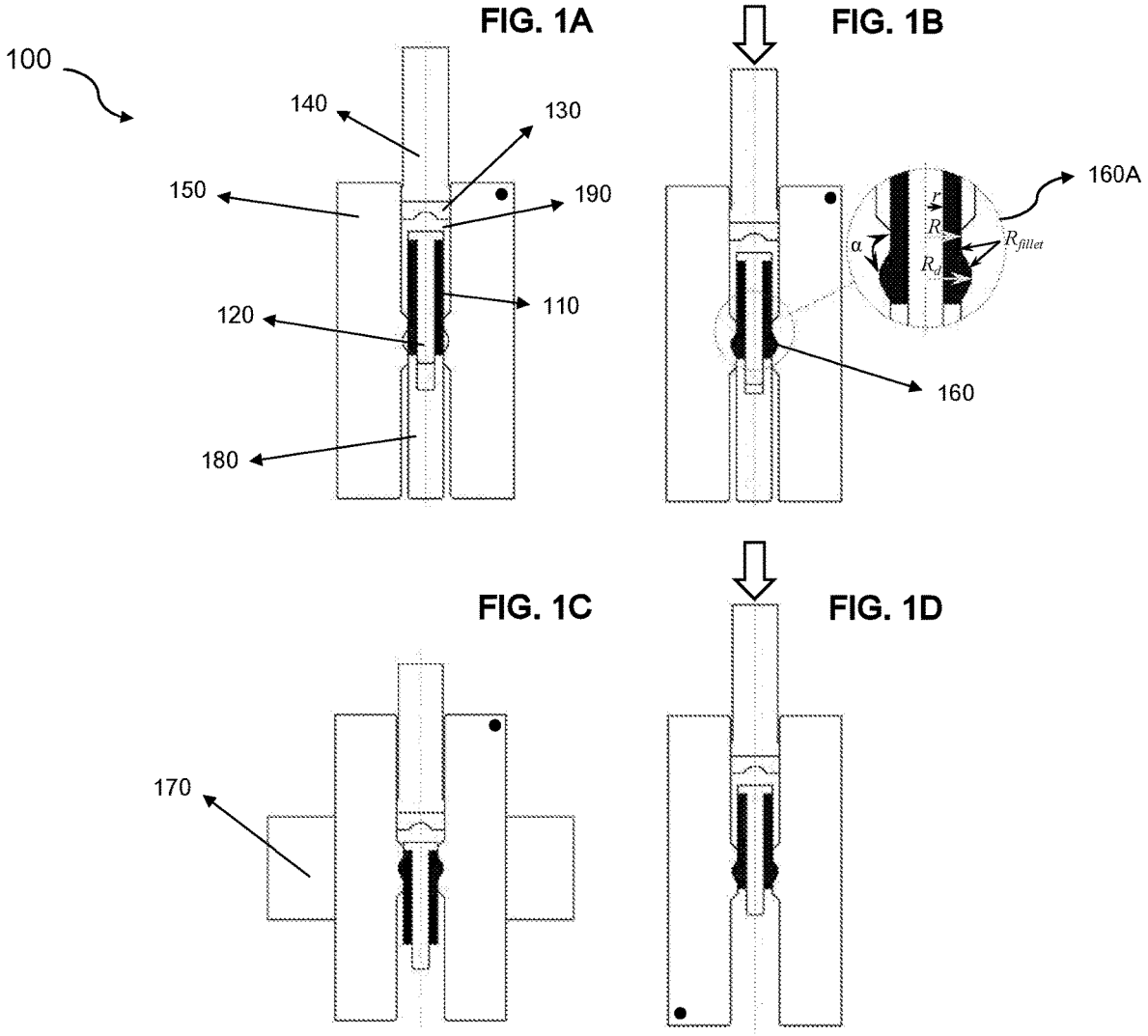
FIG. 1A through FIG. 1D are exemplary schematic drawings of an improved extrusion machine, in an aspect of providing an improved method of fabricating long nanostructured tubes, in accordance with one or more implementations.

Principles of the present invention will now be described in detail with reference to the examples illustrated in the accompanying drawings and discussed below. FIG. 1A through FIG. 2D illustrate an exemplary improved apparatus and method of SPD that can be configured to fabricate long nanostructured tubes. In this exemplary embodiment, the improved extrusion machine 100 (hereinafter "system 100") may include a moving mandrel 120, an inlet channel 130, a punch box 140, a die unit 150, a plurality of grooves 160, a holder unit 170, a stationary mandrel 180 and a lubricant material 190. In one implementation, the moving mandrel 120 may be placed inside a sample billet 110 and may extend between a first end and a second end of the sample. The moving mandrel 120 can be configured to simultaneously move with the sample billet 110 in a cooperative manner, as illustrated in FIG. 1A. The simultaneous movement of the sample billet 110 and the moving mandrel 120 may be arranged to zero out a relative velocity between the two, and to eliminate an additional amount of resistant force against the sample during extrusion. In an aspect, the moving mandrel 120 may be of a cylindrical shape and made of solid materials.

In one implementation, the inlet channel 130 may include a first end and a second end, in which the first end can be configured to load the sample billet 110, and the second end can be connected to a top end of the die unit 150, as shown in FIG. 1A. In an aspect, the inlet channel 130 may include a similar geometric shape as that of the sample billet 110. In a related aspect, the sample billet 110 may be of a tubular shape and made of solid materials. In an alternative aspect, the sample billet 110 may take a different geometric shape.

In one implementation, the punch box 140 may include a top end and a bottom end, in which the bottom end can be arranged to be in contact with the first end of the inlet channel 130 in order to push the sample billet 110 forward through the die unit 150, and to seal the inlet channel 130, as illustrated in FIG. 1B. In an aspect, a pressure force may be applied to the top end of the punch box 140 to enable pushing of the sample billet 110 through the die unit 150, as shown in FIG. 1B.

In one implementation, the die unit 150 may include the top end, a bottom end, and a plurality of grooves 160. The die unit 150 can be secured to a holder unit 170, and can be configured to extrude the sample billet 110 through the plurality of grooves 160, as further illustrated in a deformation zone 160A in FIG. 1B. The deformation zone 160A shows the plurality of grooves 160 each of which may include an expanded section with a larger diameter than other sections of the groove. The plurality of grooves 160 can be configured to expand the sample billet 110 through the expanded section of the grooves. Extrusion through the expanded section of each of the plurality of grooves 160 can be configured to reduce the diameter of the expanded sample to an original diameter. Geometric parameters of the deformation zone 160A are also shown in FIG. 1B.

In one implementation, the stationary mandrel 180 may include a first end and a second end, in which the first end may be arranged to be in contact with the sample billet 110, and the second end can be configured to extend to the bottom end of the die unit 150. In an aspect, the stationary mandrel 180 may be configured to initially apply back pressure to the sample billet 110, and to reduce the diameter of the expanded section of the plurality of grooves 160 inside the die unit 150. In an alternative aspect, the stationary mandrel 180 may be removed after an initial use, as illustrated in FIG. 1C, and then, the die unit 150 may be inverted to be upside down after each extrusion cycle in order for the punch box 140 to extrude the sample billet 110 through the plurality of grooves 160, as shown in FIG. 1D. In the alternative aspect, the increased diameter of the sample billet 110 may be reduced to the original diameter without a need to use the stationary mandrel 180 for applying back pressure after the initial use.

In one implementation, a lubricant material 190 may be poured inside the die unit 250 to fill a space gap between the sample billet 110 and the die unit 150, and to avoid a direct contact between the two, as shown in FIG. 1A. The lubricant material 190 may prevent creation of friction forces between the sample billet 110 and the die unit 150, and may eliminate an additional amount of resistant force against the sample during extrusion. Furthermore, the lubricant material 190 may apply a hydrostatic pressure to the sample billet 110, and may reduce an amount of required force for the punch box 140 to push the sample through the die unit 150 during extrusion. The reduction in the applied forces may allow continuation of an additional cycle of extrusion without a need to constrain a sample length. In an aspect, the lubricant material 190 may include an oil.

Figure 2:
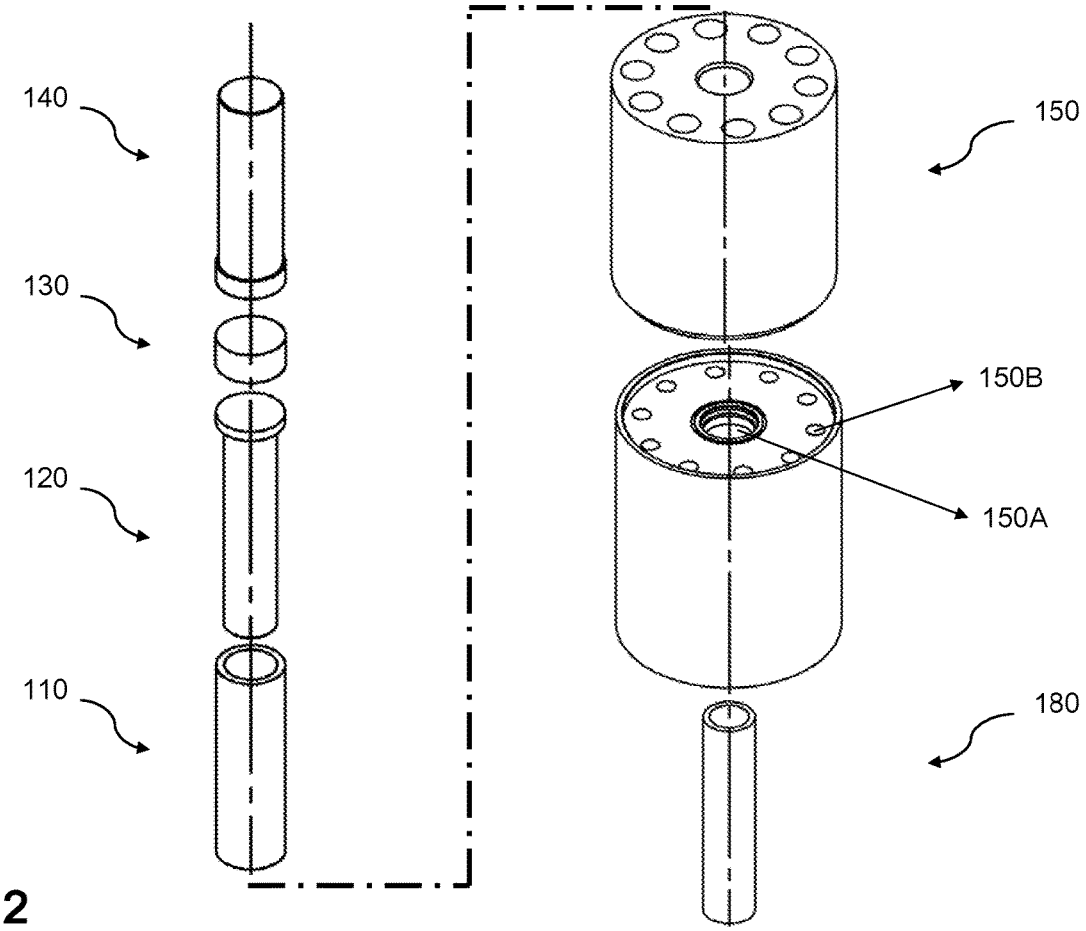
FIG. 2 illustrates an exemplary perspective view of compartments inside an improved extrusion machine, in an aspect of providing an improved method of fabricating long nanostructured tubes, in accordance with one or more implementations.

FIG. 2 is an exemplary perspective view of compartments inside the system 100 that can be configured to fabricate long nanostructured tubes. Shown are the sample billet 110, the moving mandrel 120, the inlet channel 130, the punch box 140, the die unit 150, a central opening 150A and a plurality of peripheral openings 150B of the die unit 150, and the stationary mandrel 180.

Figure 3A:
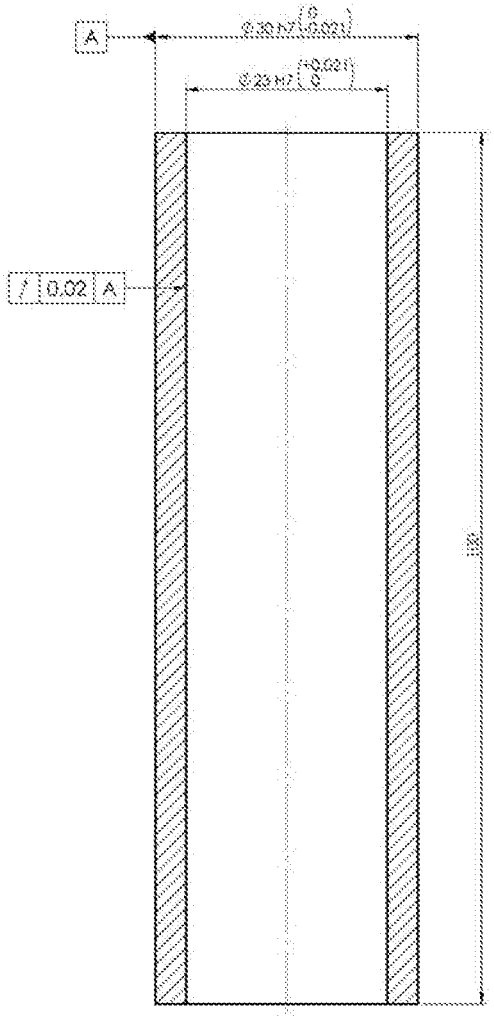
FIG. 3A through FIG. 3F are exemplary schematic drawings of compartments inside an improved extrusion machine, in an aspect of providing an improved method of fabricating long nanostructured tubes, in accordance with one or more implementations.

FIG. 3A through FIG. 3F are exemplary schematic drawings of compartments inside the system 100 that can be configured to fabricate long nanostructured tubes. In this exemplary embodiment, FIG. 3A shows the schematic drawing of the sample billet 110 viewed from a side perspective. As one example, specific dimensions of the sample billet 110 are also shown in FIG. 3A. In one implementation, each extrusion cycle may apply an amount of strain on the sample billet 110, each of which strain can severely deform the sample, and can further refine a nanostructure of such sample. A total amount of strain applied on the sample billet 110 may be equal to a summation of each of the amount of strain applied in each extrusion cycle. The refined nanostructure of the sample billet 110 may introduce an ultrafine grained tube with high mechanical strength and long length.

Figure 3B:
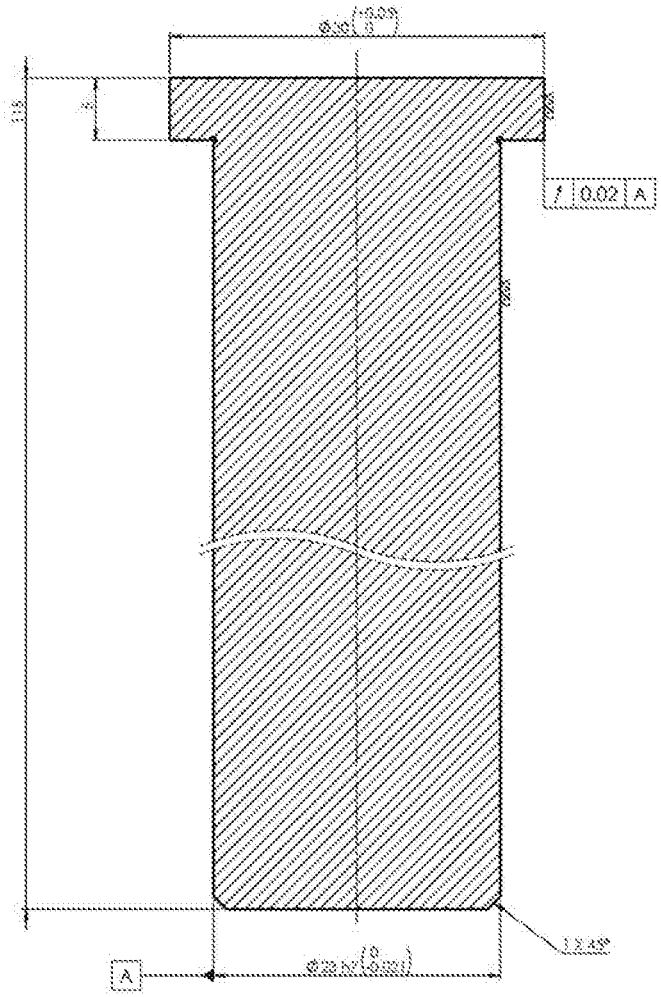
Figure 3C:
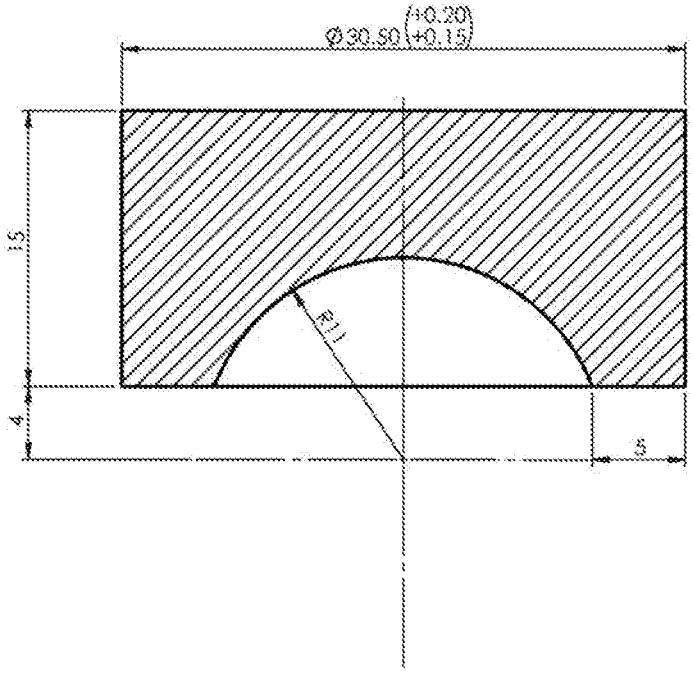

In this exemplary embodiment, FIG. 3B shows the schematic drawing of the moving mandrel 120 viewed from a side perspective. As one example, specific dimensions of the moving mandrel 120 are shown in FIG. 3B. FIG. 3C shows the schematic drawing of the inlet channel 130 viewed from a side perspective. As one example, specific dimensions of the inlet channel 130 are shown in FIG. 3C.

Figure 3D:
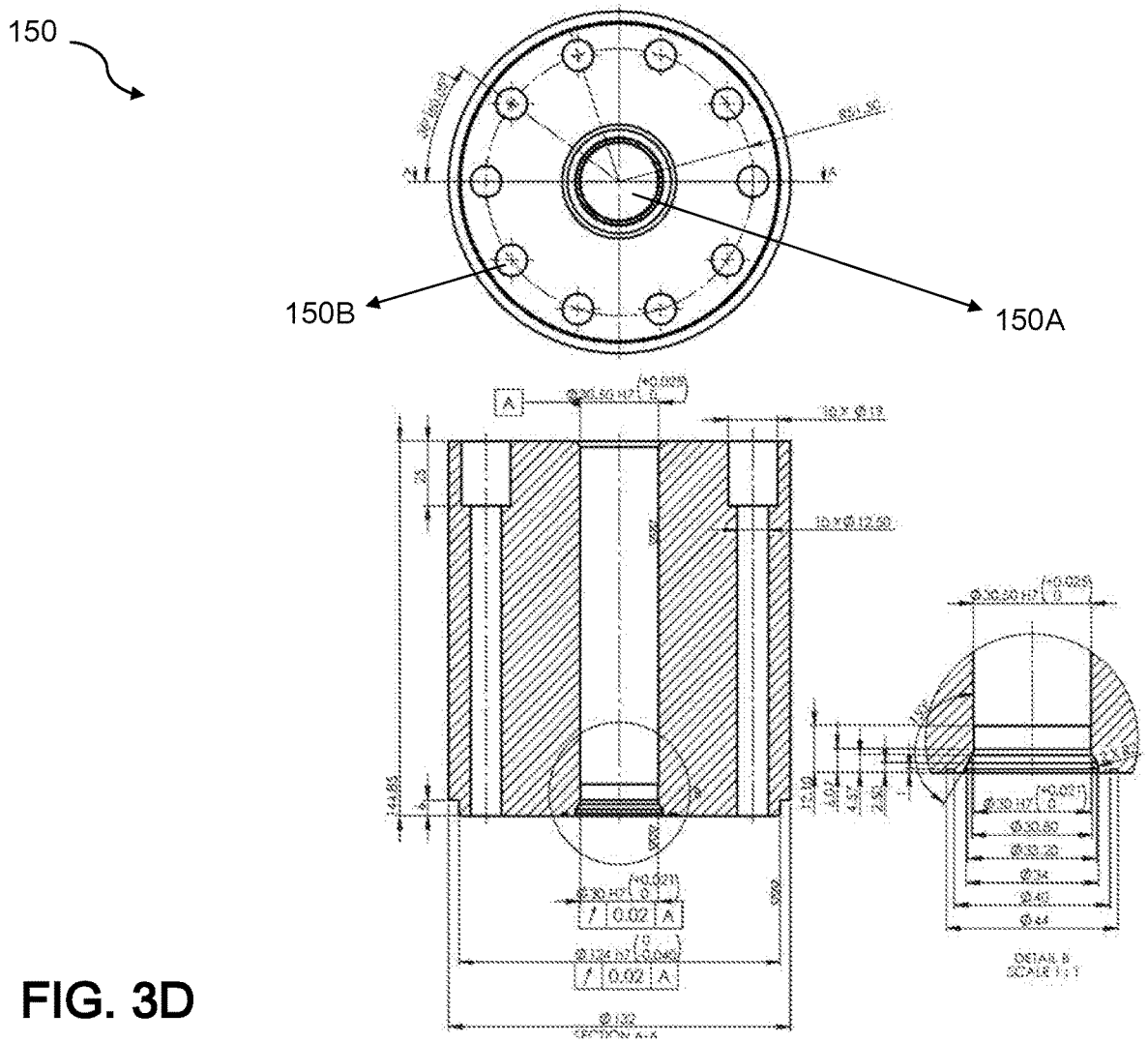
Figure 3E:
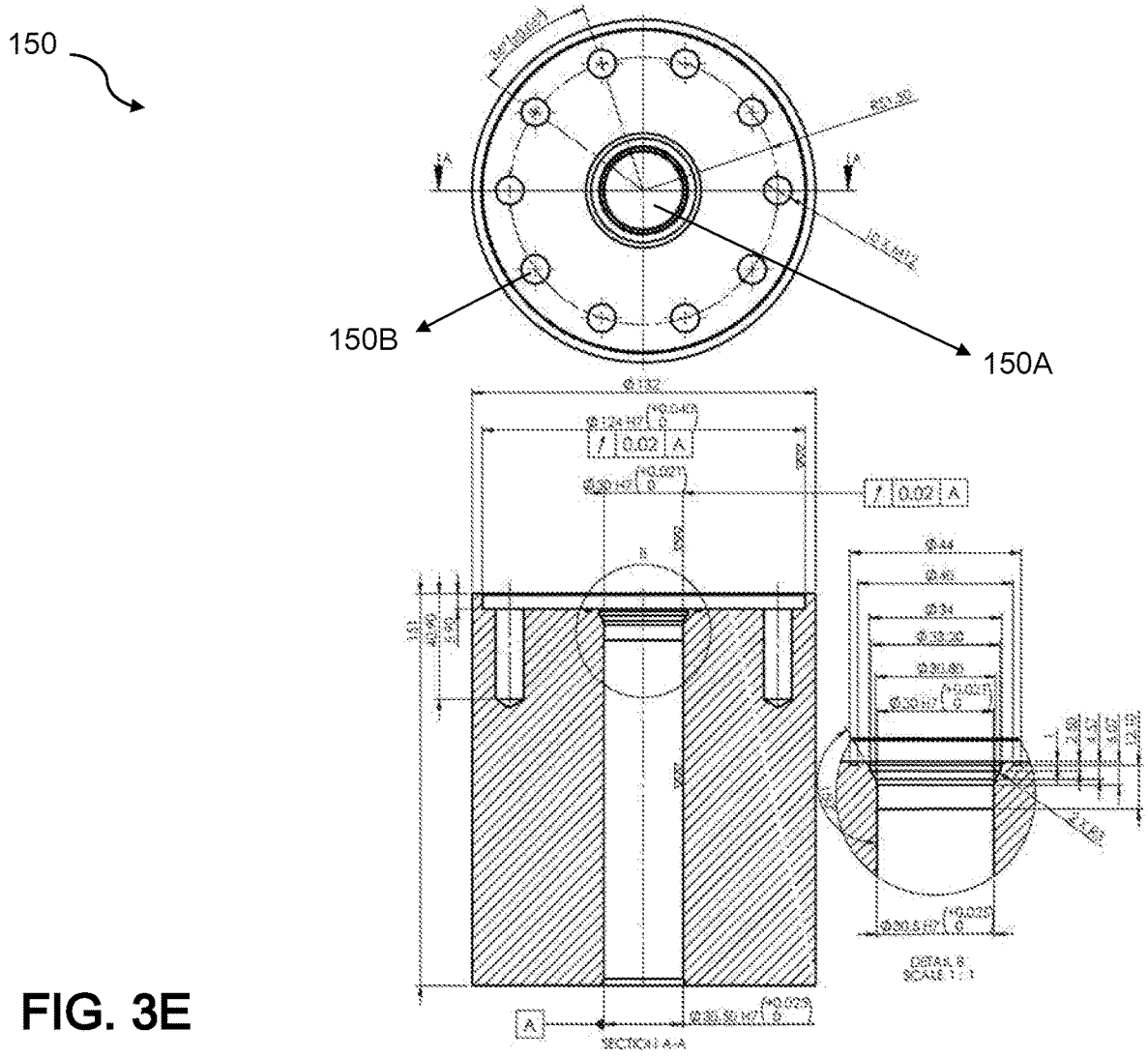

In this exemplary embodiment, FIG. 3D shows the schematic drawing of the die unit 150 viewed from a top and a side view. FIG. 3E shows the schematic drawing of the die unit 150 viewed from a bottom and another side view. The die unit may include the central opening 150A and the plurality of peripheral openings 150B, and can be configured to expand and extrude the sample billet 110. The central opening 150A can be configured to allow loading of the sample billet 110 through the die unit 150. The plurality of peripheral openings 150B can be configured to control shrinkage and flow characteristic of the sample billet 110 during extrusion. In an aspect, the die unit 150 may be of a cylindrical shape and made of solid materials. As one example, specific dimensions of the die unit 150 are shown in FIG. 3D and FIG. 3E.

Figure 3F:
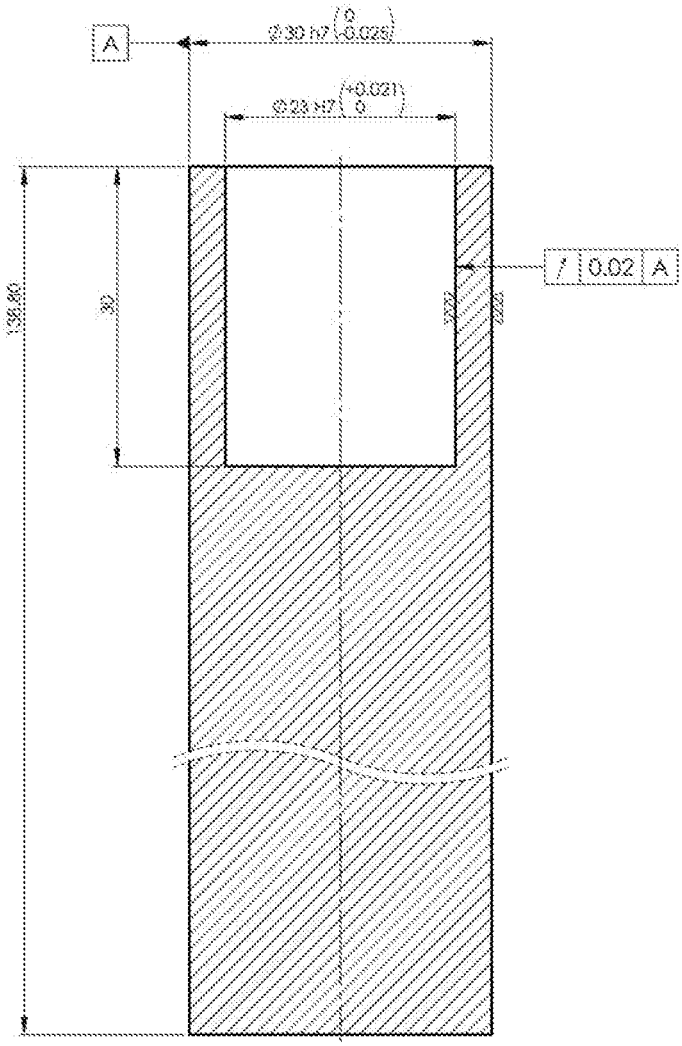

In this exemplary embodiment, FIG. 3F shows the schematic drawing of the stationary mandrel 180 viewed from a side perspective. As one example, specific dimensions of the stationary mandrel 180 are shown in FIG. 3F.

Figure 4:
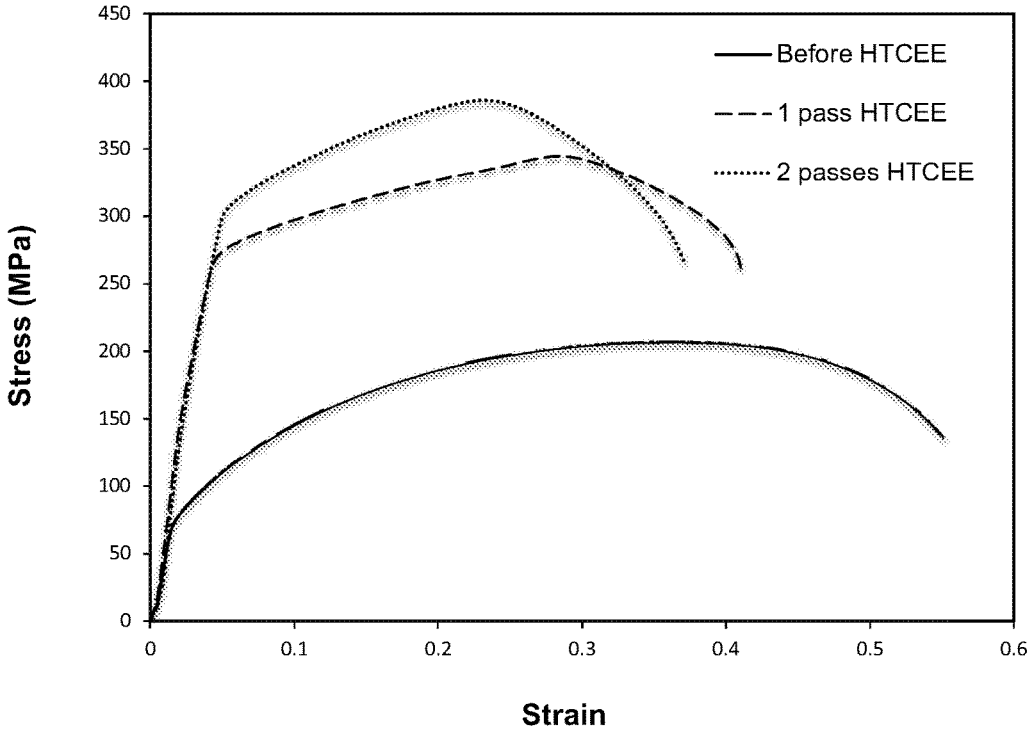
FIG. 4 is an exemplary chart showing mechanical properties of a processed vs. an unprocessed sample, in an aspect of providing an improved method of fabricating long nanostructured tubes, in accordance with one or more implementations.

To investigate the applicability of the improved method of fabricating long nanostructured tubes, the method was applied to a sample specimen made of pure copper. Microstructure and mechanical properties of the resulting processed sample were then compared to an unprocessed annealed copper in order to determine the effects of the improved method. FIG. 4 are exemplary true stress-strain curves for the unprocessed annealed sample as compared to the processed sample after a first and a second extrusion pass. In this exemplary illustration, the unprocessed annealed sample may present low maximum tensile strength with low ultimate tensile strength. However, significant improvements in a maximum tensile strength and an ultimate tensile strength can be observed for the processed sample after the first and second extrusion passes.

In the implementation illustrated in FIG. 4, the tensile strength may increase from an initial value of 70 MPa to respectively 270 MPa and 300 MPa for the first and second passes of the cyclic expansion extrusion. Likewise, the ultimate tensile strength may increase from an initial value of 206 MPa to respectively 345 MPa and 385 MPa for the first and second passes of the cyclic expansion extrusion.

The improvements can indicate that the increase in the tensile strength in the processed sample after the first and second passes of the cyclic expansion extrusion can come with a reduced amount of percentage in a sample elongation as compared to the unprocessed annealed sample. This can ultimately result in fabricating long high strength samples with higher flexibility and malleability to different shapes. The reasoning behind this fact may refer to an effect of a uniform hydrostatic pressure applied in all directions on the processed sample during each cyclic expansion extrusion. Higher hydrostatic pressure can result in a smaller number of cracks, and thus fewer propagation of crack and micro-voids, which can ultimately increase the tensile strength of the processed sample. In an aspect, the unprocessed annealed sample may include dimensions of, e.g., 100 mm in length, 30 mm in external diameter, and 3.5 mm in thickness.

Accordingly, the improved apparatus and method of fabricating long nanostructured tubes in the present invention can provide an efficient mechanism for expanding and extruding a material through cyclic deformations. The evident results may reveal that by eliminating resistant forces applied on the material, a nanostructured tube with high strength and long length can be fabricated without the need to repeatedly apply back pressure to the material via a heavy mandrel unit during each extrusion cycle, and without the need to constrain a length of the material.

The separation of various components in the examples described above should not be understood as requiring such separation in all examples, and it should be understood that the described components and systems can generally be integrated together in a single packaged into multiple systems.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

The scope of protection is limited solely by the claims that now follow. That scope is intended and should be interpreted to be as broad as is consistent with the ordinary meaning of the language that is used in the claims when interpreted in light of this specification and the prosecution history that follows and to encompass all structural and functional equivalents. Notwithstanding, none of the claims are intended to embrace subject matter that fails to satisfy the requirement of Sections 101, 102, or 103 of the Patent Act, nor should they be interpreted in such a way. Any unintended embracement of such subject matter is hereby disclaimed.

Except as stated immediately above, nothing that has been stated or illustrated is intended or should be interpreted to cause a dedication of any component, step, feature, object, benefit, advantage, or equivalent to the public, regardless of whether it is or is not recited in the claims.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a" or "an" does not, without further constraints, preclude the existence of additional identical elements in the process, method, article, or apparatus that comprises the element.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various implementations for the purpose of streamlining the disclosure. This method of disclosure is not to be interpreted as reflecting an intention that the claimed implementations require more features than are expressly recited in each claim. Rather, as the following claims reflect, inventive subject matter lies in less than all features of a single disclosed implementation. Thus, the following claims are hereby incorporated into the Detailed Description, with each claim standing on its own as a separately claimed subject matter.

What is claimed is:

1. An apparatus for fabricating a nanostructured tube from a sample billet, comprising:

a moving mandrel;

wherein the moving mandrel is configured to be positioned inside the sample billet such that the moving mandrel simultaneously moves with the sample billet, the moving mandrel extending between a first end of the sample billet and a second end of the sample billet;

a holder unit;

a die unit having a top end, a bottom end, and a plurality of grooves, the die unit secured to the holder unit, and the die unit configured to extrude the sample billet through the plurality of grooves to increase a diameter of the sample billet;

an inlet channel having a first end and a second end, the first end configured to load the sample billet, and the second end connected to the top end of the die unit;

a punch box having a top end and a bottom end, the bottom end of the punch box in contact with the first end of the inlet channel, the punch box configured to push the sample billet forward through the die unit and to seal the inlet channel;

a lubricant material inside the die unit is configured to fill a space gap between the sample billet and the die unit, and to avoid a direct contact between the sample billet and the die unit; and a stationary mandrel having a first end and a second end, the first end of the stationary mandrel in contact with the sample billet, the second end of the stationary mandrel extending to the bottom end of the die unit, the stationary mandrel configured to apply back pressure to the sample billet;

wherein:

the stationary mandrel is arranged to apply back pressure to the sample billet to reduce the increased diameter of the sample billet during an initial extrusion cycle, the stationary mandrel is arranged to be removed after the initial extrusion cycle, and the die unit is arranged to be inverted after the initial extrusion cycle in order for the punch box to further extrude the sample billet through the plurality of grooves, and to further reduce the increased diameter of the sample billet.

2. The apparatus of claim 1, wherein the moving and stationary mandrels have cylindrical shapes and are made of solid materials.

3. The apparatus of claim 1, wherein the die unit has a cylindrical shape, and a cross-section of the die unit includes a central opening and a plurality of peripheral openings in which the central opening is configured to allow loading of the sample billet through the die unit, and the plurality of peripheral openings are configured to control a shrinkage and flow characteristic of the sample billet during extrusion.

4. The apparatus of claim 1, wherein each one of the plurality of grooves inside the die unit includes an expanded section with a larger diameter than other sections of the groove to increase the diameter of the sample billet during extrusion.

5. The apparatus of claim 1, wherein a position of the moving mandrel inside the sample billet reduces a relative velocity between the sample billet and the moving mandrel to reduce a resistance force against the sample billet during extrusion.

6. The apparatus of claim 5, wherein the lubricant material prevents friction between the sample billet and the die unit to reduce an amount of the resistance force against the sample billet during extrusion.

7. The apparatus of claim 6, wherein the lubricant material applies a hydrostatic pressure to the sample billet to reduce an amount of force required for the punch box to push the sample billet forward through the die unit during extrusion.

8. The apparatus of claim 7, wherein reduction in the amount of force required allows continuation of additional cycles of extrusion without a need to constrain a sample length.

9. The apparatus of claim 1, wherein during an extrusion cycle at least one of the stationary mandrel or the punch box applies an amount of strain on the sample billet, and the amount of strain deforms the sample billet to generate an ultrafine grained nanostructure for the sample billet.

10. The apparatus of claim 9, wherein a total amount of strain applied on the sample billet is equal to a summation of each of the amount of strain applied in each of the extrusion cycles.

11. The apparatus of claim 9, wherein the ultrafine grained nanostructure increases a mechanical strength of the sample billet.

12. A method of fabricating a nanostructured tube comprising:

placing a moving mandrel inside a sample billet;

loading the sample billet into an inlet channel of an extrusion machine, the extrusion machine including a punch box, a die unit and a stationary mandrel, a top end of the die unit in contact with one end of the punch box and a bottom end of the die unit extended to one end of the stationary mandrel;

pouring an amount of a lubricant material inside the die unit to fill a space gap between the sample billet and the die unit, and to avoid a direct contact between the sample billet and the die unit;

applying pressure by the punch box to push the sample billet forward through a plurality of grooves inside the die unit to increase a diameter of the sample billet and to seal the inlet channel;

applying back pressure by the stationary mandrel to extrude the sample billet through the plurality of grooves inside the die unit;

removing the stationary mandrel;

inverting the die unit;

upon removing the stationary mandrel and inverting the die unit, applying further pressure by the punch box to further extrude the sample billet through the plurality of grooves to reduce the increased diameter of the sample billet; and repeating steps of inverting the die unit and applying further pressure by the punch box to further extrude the sample billet through the plurality of grooves a plurality of times.

13. The method of fabricating a nanostructured tube of claim 12, wherein a simultaneous movement of the sample billet and the moving mandrel zeros out a relative velocity between the sample billet and the moving mandrel to reduce a resistant force against the sample billet during extrusion.

14. The method of fabricating a nanostructured tube of claim 12, wherein the lubricant material prevents friction between the sample billet and the die unit to reduce a resistance force against the sample billet during extrusion.

15. The method of fabricating a nanostructured tube of claim 12, wherein extrusion through the plurality of grooves inside the die unit reduces the increased diameter of the sample billet to an original diameter of the sample billet.

16. The method of fabricating a nanostructured tube of claim 12, wherein the lubricant material applies a hydrostatic pressure to the sample billet to reduce an amount of force required for the punch box to push the sample billet through the die unit during extrusion.

17. The method of fabricating a nanostructured tube of claim 16, wherein the reduction in the amount of force required allows continuation of cycles of extrusion without a need to constrain a sample length.

18. The method of fabricating a nanostructured tube of claim 12, wherein, during extrusion cycles, an amount of strain is applied on the sample billet, and the amount of strain deforms the sample billet to generate an ultrafine grained nanostructure for the sample billet.

19. The method of fabricating a nanostructured tube of claim 18, wherein a total amount of strain applied on the sample billet is equal to a summation of the amount of strain applied in each of the extrusion cycles.

20. The method of fabricating a nanostructured tube of claim 18, wherein the ultrafine grained nanostructure of the sample billet increases a mechanical strength of the sample billet.

* * * * *